United States Patent [19]

Ito et al.

[11] Patent Number: 5,075,653

[45] **Date of Patent: * Dec. 24, 1991**

[54] METHOD OF ADJUSTING A FREQUENCY RESPONSE IN A THREE-CONDUCTOR TYPE FILTER DEVICE

[75] Inventors: Kenji Ito; Hiroyuki Shimizu, both of Nagoya, Japan

[73] Assignee: NGK Spark Plug Co., Ltd., Japan

[ * ] Notice: The portion of the term of this patent subsequent to Dec. 4, 2007 has been disclaimed.

[21] Appl. No.: 517,330

[22] Filed: May 1, 1990

[30] Foreign Application Priority Data

May 3, 1989 [JP] Japan ..... 1-113222

[51] Int. Cl.[5] ..... H01P 1/203

[52] U.S. Cl. ..... 333/205; 333/204; 333/235

[58] Field of Search ..... 333/202–205, 333/235, 246, 219

[56] References Cited

U.S. PATENT DOCUMENTS 4,157,517 6/1979 Kneisel et al. ..... 333/205
4,288,530 9/1981 Bedard et al. ..... 333/205 X
4,609,892 9/1986 Higgins, Jr. ..... 333/204
4,963,843 10/1990 Perkham ..... 333/203

FOREIGN PATENT DOCUMENTS 0100002 5/1986 Japan ..... 333/204
0201501 9/1986 Japan ..... 333/204
0263702 11/1987 Japan ..... 333/204

*Primary Examiner*—Eugene R. Laroche
*Assistant Examiner*—Senng Ham
*Attorney, Agent, or Firm*—Larson and Taylor

[57] ABSTRACT

A method of adjusting a frequency response in a filter device of a three-conductor type having a pair of stacked dielectric substrates with a plurality of strip-line resonator conductors being sandwiched therebetween, wherein the frequency adjusting of the filter is performed by partially removing the ground conducting layer provided on the peripheral portion of each dielectric substrate at regions corresponding to the open circuit ends, or to the open circuit ends and the short circuit ends of the resonator conducting layers.

7 Claims, 5 Drawing Sheets

METHOD OF ADJUSTING A FREQUENCY RESPONSE IN A THREE-CONDUCTOR TYPE FILTER DEVICE

BACKGROUND OF THE INVENTION

The present invention relates to a method of adjusting a frequency response in a filter device of three-conductor type which may be used as a band-pass filter for example.

It is known to provide a filter device of three-conductor type which is utilized as a band-pass filter for a microwave range. An example of such a conventional filter device is illustrated in FIGS. 1 and 2. As will be seen in FIGS. 1 and 2, it comprises a lower dielectric substrate. 1 and an upper dielectric substrate 2 which are stacked with respect to each other. Each of the dielectric substrates 1 and 2 may be of dielectric ceramic material having a high dielectric constant and a lower dielectric loss such as $BaO—TiO_2$, $BaO—TiO_2$-rare earth or the like. The lower dielectric substrate 1 is provided with an external ground conducting layer 3 on the peripheral portion and bottom surface thereof. Similarly, the upper dielectric substrate 2 is provided with an external ground conducting layer 4 on the peripheral portion and upper surface thereof. On the upper surface of the lower dielectric substrate 1 are disposed a plurality of stripline resonator conducting layers 5, 6 and 7 which form a filter element. Each resonator conducting layer has one end or an open circuit end (5*a*, 6*a* and 7*a*) spaced from the ground conducting layer 3 and the other end or a short circuit end (5*b*, 6*b* and 7*b*) connected to the ground conducting layer 3. The open circuit ends 5*a*, 6*a* and 7*a* of the respective resonator conducting layers 5, 6 and 7 are alternately disposed so as to form an interdigitated configuration. The upper dielectric substrate 2 is fixed on the lower dielectric substrate 1, and the ground conducting layers 3 and 4 of the respective dielectric substrates are connected to each other.

As well known in the art, the filter device of this type has a frequency response which depends on the the configuration and dielectric constant of the substrates, and the dimension of the resonator conductors. Upon the manufacturing of the filter device the dielectric constant of the substrates and the size of the resonator conducting layers are strictly determined. However, it can not be avoided that there may occur deviations in the dielectric constant of the substrates and in the dimension of the resonator conducting layers. It is, therefore, necessary to adjust the frequency response of the filter device after being completed.

The adjustment of the frequency response can not be performed by adjusting the length of the resonator conducting layers because they are embeded in the dielectric substrates. One solution to this problem has been proposed in U.S. Pat. No. 4,157,517. According to the adjusting method disclosed in this U.S. Patent, the frequency of the filter is previously set at a lower level than a desired one, and the external conductor or ground conducting layer 4 provided on the upper surface of the upper substrate 2 is partially removed at regions 8 adjacent the open circuit ends of the resonator conducting layers 5, 6 and 7 to reduce the capacitance between the external conducting layer 4 and the respective resonator conducting layers and to increase the response frequency of the filter thereby making it possible to adjust the frequency.

However, with this adjusting method, when the assembled filter is to be contained in an outer casing 9 after the adjustment of the frequency response is made, the removed regions 8 for the frequency adjustment of the upper surface of the upper dielectric substrate 2 come close to or come into contact with the upper wall of the outer casing 9 because the removed regions 8 are positioned on the upper surface of the upper dielectric substrate 2. Therefore, the stray capacitance may be changed from the adjusted value so that the frequency response may deviate. For this reason, if the above mentioned adjusting method is applied, the outer casing should be so designed that it has an inner height larger than the height of the filter assembly and the upper surface of the upper dielectric substrate 2 is sufficiently spaced from the upper wall of the casing 9 as will be seen in FIG. 2. Recently, various equipments or elements adapted for use in a microwave range becomes thinner and it is thus demanded that the filter devices as well as the elements should be constructed in a thinner configuration or dimension.

However, such a demand for a thinner construction can not be satisfied by utilizing the above mentioned adjusting method in which a casing having a larger inner height is necessarily used.

SUMMARY OF THE INVENTION

It is therefore an object of the present invention to provide a method of adjusting a frequency response of a filter device of a three-conductor structure type in which there can be compensated any variation in the frequency which may occur when the filter is contained in a casing.

Another object of the invention is to provide a filter device of a three-conductor structure type which fully meets with the requirement for smaller and thinner dimension.

According to one aspect of the present invention, there is provided a method of adjusting a frequency response of a filter device of a three-conductor structure type in which it comprises a pair of dielectric substrates each having a peripheral and outer surfaces provided with an external ground conducting layer, and a plurality of stripline resonator conducting layers sandwiched between the dielectric substrates, each resonator conducting layer having a short circuit end connected to the ground conducting layer on one lateral surface of each substrate and an open circuit end spaced from the ground conducting layer on the opposite lateral surface of each substrate, wherein the external ground conducting layer on the peripheral surface of each substrate is partially removed at a portion which corresponds to the open circuit end of each resonator conducting layer for to tuning the filter device for a desired frequency response.

According to a second aspect of the present invention, there is provided a method of adjusting a frequency response of a filter device of a three-conductor structure type in which it comprises a pair of dielectric substrates each having a peripheral and outer surfaces provided with an external ground conducting layer, and a plurality of stripline resonator conducting layers sandwiched between the dielectric substrates, each resonator conducting layer having a short circuit end connected to the ground conducting layer on one lateral surface of each substrate and an open circuit end spaced from the ground conducting layer on the opposite lateral surface of each substrate, characterized in that the external ground conducting layer on the peripheral surface of each substrate is partially removed at a portion which corresponds to the open circuit end of each resonator conducting layer for tuning the filter device to a desired frequency response, and the external ground conducting layer on the peripheral surface of each substrate is partially removed at a portion which corresponds to the short circuit end of each resonator conducting layer for compensating any overshoot of the adjustment preformed by the first removing step.

According to a third aspect of the present invention, there is provided a method of adjusting a frequency response of a filter device of a three-conductor structure type in which it comprises a pair of dielectric substrates each having a peripheral surface provided with a plurality of recesses and an outer surface, an external ground conducting layer provided on the peripheral and outer surfaces of each dielectric substrate, and a plurality of stripline resonator conducting layers sandwiched between the dielectric substrates, each resonator conducting layer having a short circuit end connected to the ground conducting layer on one lateral surface of each substrate and an open circuit end spaced from the ground conducting layer on the opposite lateral surface of each substrate, wherein the external ground conducting layer on the peripheral surface of each substrate is partially removed at a portion which corresponds to the open circuit end of each resonator conducting layer for tuning the filter device to a desired frequency response.

By removing partially the external ground conducting layer on the peripheral surface of each substrate at a portion which corresponds to the open circuit end of each resonator conducting layer, the capacitance between each removed portion and the associated open circuit end of each resonator conducting layer is reduced.

The present invention will now be described by way of example with reference to the accompanying drawings.

DETAILED DESCRIPTION

Figure 1:
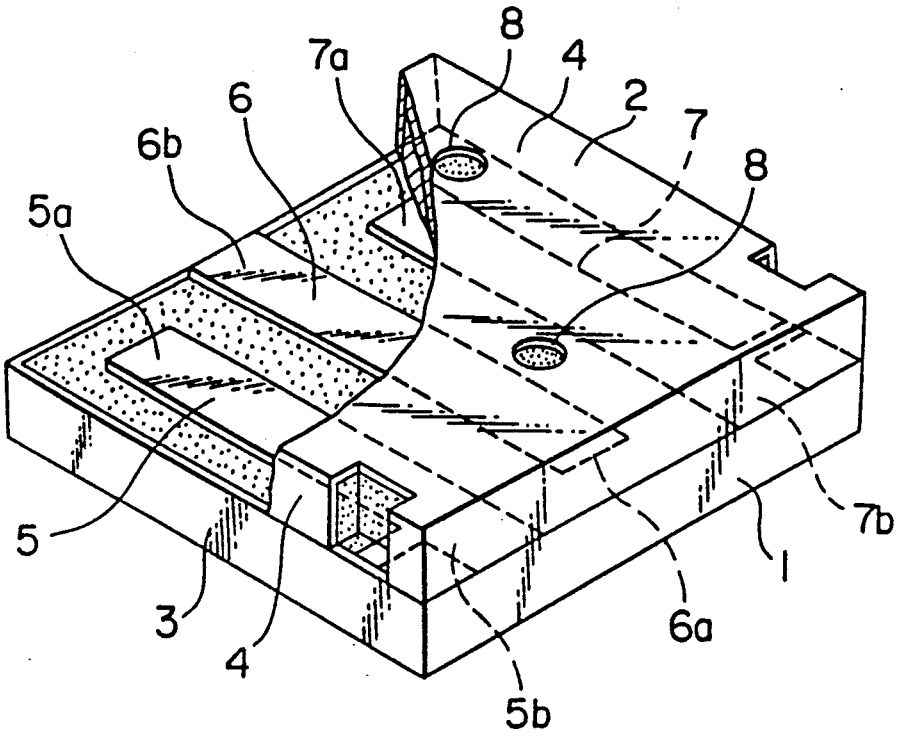
FIG. 1 PRIOR ART
FIG. 1 is a perspective partially cutaway view showing a prior art three-conductor type filter device.
Figure 2:
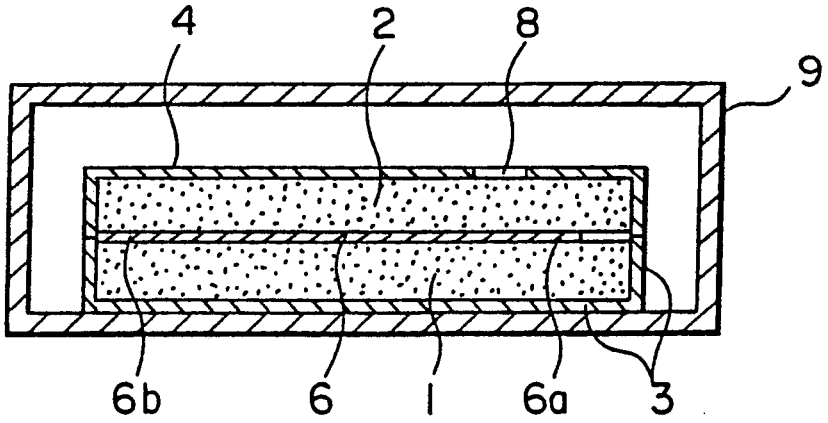
FIG. 2 PRIOR ART
FIG. 2 is a longitudinal section showing the filter device of FIG. 1 contained in a casing.
Figure 3:
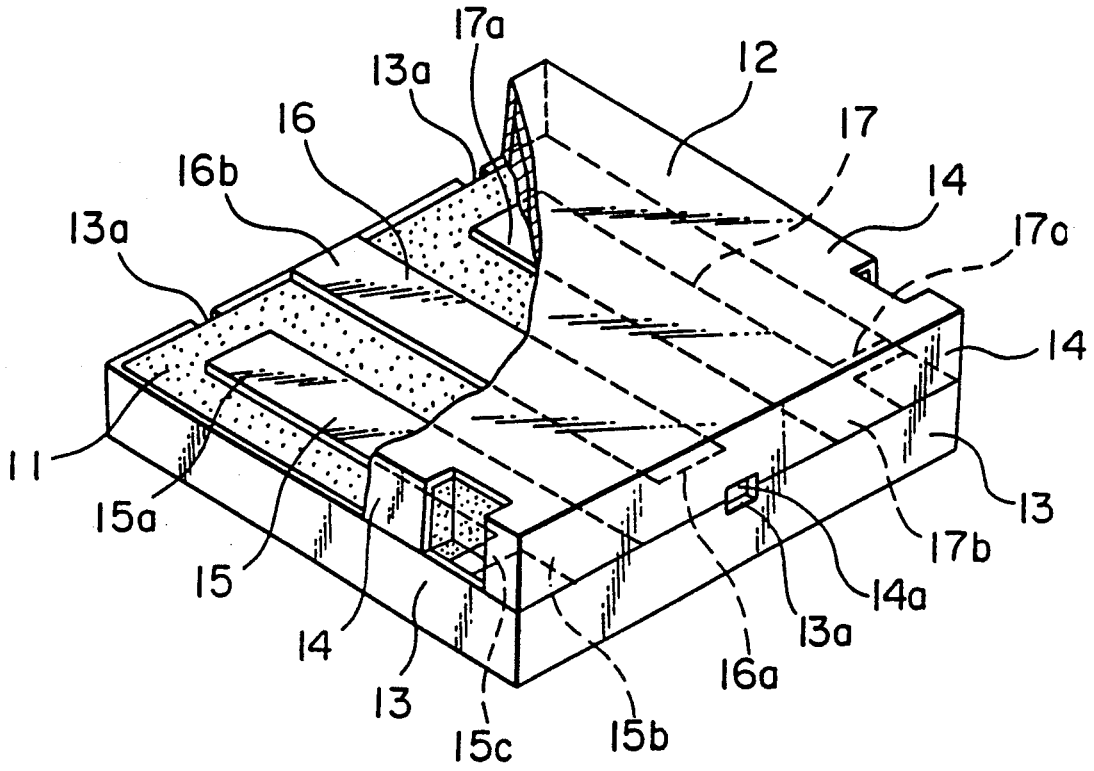
FIG. 3 is a perspective partially cutaway view schematically showing a filter whose frequency response is adjusted in accordance with one embodiment of the present invention.
Figure 4:
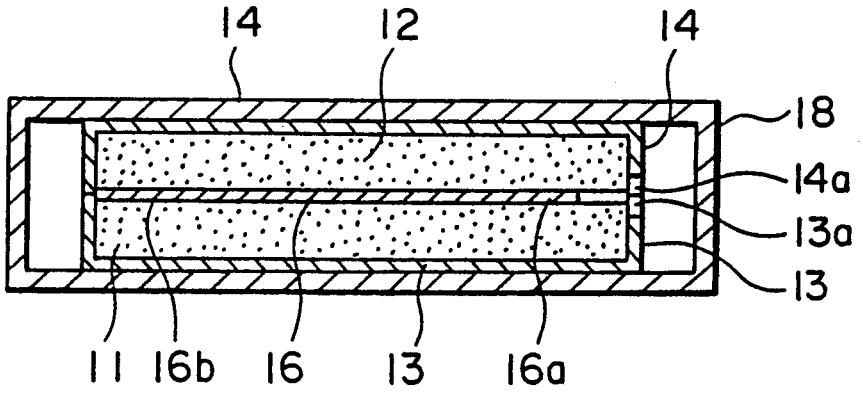
FIG. 4 is a longitudinal section showing the filter device of FIG. 3 contained in a casing.

FIGS. 3 and 4 show a three-conductor type filter constructed in accordance with one embodiment of the present invention.

Figure 9:
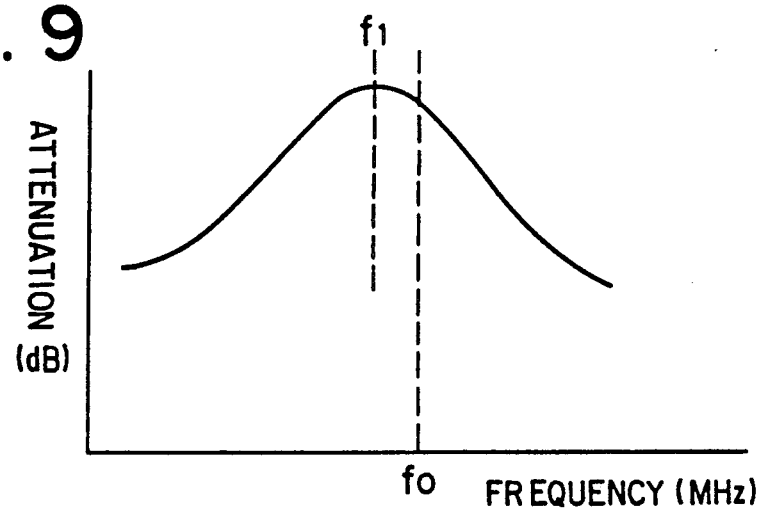
FIGS. 9 and 10 are graphes showing the frequency responses of the filter before the frequency adjustment is made.

The illustrated filter comprises a lower and upper dielectric substrates 11 and 12 which are stacked to each other upon the assembling of the filter. Each of the dielectric substrates 11 and 12 may be of dielectric ceramic material having a high dielectric constant and a lower dielectric loss such as $BaO—TiO_2$, $BaO—TiO_2$-rare earth or the like. The lower dielectric substrate 11 is provided with an external ground conducting layer 13 on the peripheral portion and outer surface thereof. Similarly, the upper dielectric substrate 12 is provided with an external ground conducting layer 14 on the peripheral portion and upper or outer surface thereof. On the upper or inner surface of the lower dielectric substrate 11 are provided a plurarity of stripline resonator conducting layers 15, 16 and 17 which form a filter element of an interdigital type. In this connection, it is substantially unavoidable that there may occur any deviations in the dielectric constants of the used substrates and/or in the dimension of the resonator conducting layers upon the manufacturing, which results in that the frequency response of the completed filter may be deviated from an intended one. Therefore, the dimensions of resonator conducting layers 15, 16 and 17 are determined so that the resonance frequency of the filter becomes slightly lower than the intended one as shown in FIG. 9. Each resonator conducting layer has one end or an open circuit end (15*a*, 16*a* and 17*a*) spaced from the ground conducting layer 13 and the other end or a short circuit end (15*b*, 16*b* and 17*b*) connected to the ground conducting layer 13. The open circuit ends 15*a*, 16*a* and 17*a* of the respective resonator conducting layers 15, 16 and 17 are alternately disposed so as to form an interdigital type resonator. The upper dielectric substrate 12 is fixed on the lower dielectric substrate 11, and the ground conducting layers 13 and 14 of the respective dielectric substrates are connected to each other.

The resonator conducting layers 15 and 17 have lateral extensions 15*c* and 17*c*, respectively. One of the lateral extensions 15*c* and 17*c* is connected to a signal input terminal, not shown, and the other extension is connected to a signal output terminal, not shown.

With the three-conductor type filter thus constructed, in order to compensate any deviations in the dielectric constants of the used dielectric substrates 11 and 12 and in the length of each resonator conducting layer it is necessary to adjust the frequency of the filter after the dielectric substrates 11 and 12 are assembled with the resonator conducting layers sandwiched therebetween. To this end, the external ground conducting layer provided on the peripheral surface of each substrate is partially removed at a portion (13*a* and 14*a*) which corresponds to the open circuit end of each resonator conducting layer so as to reduce the capacitance between each removed portion and the associated resonator conducting layer. This removing operation may be performed by means of a cutting tool, laser beam machining, sand blasting or the like. In this way, the filter can be tuned to a desired frequency response.

Figure 11:
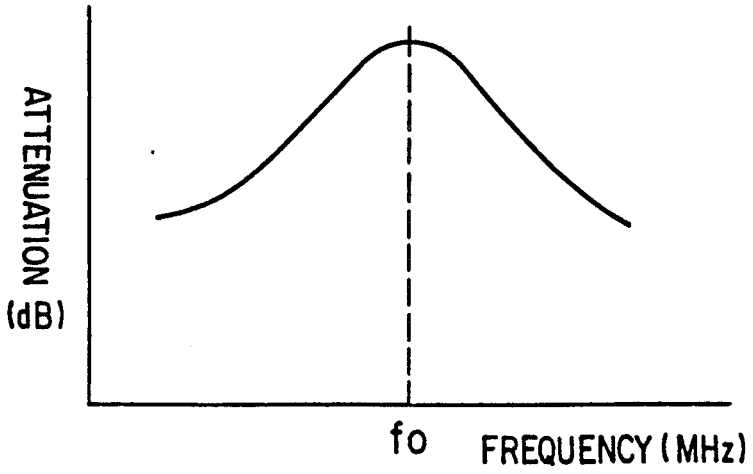
FIG. 11 is a graph showing the frequency response of the filter adjusted in accordance with the present invention.

That is, as shown in FIG. 9, the filter has a center frequency $f_1$ which is slightly lower than a desired response frequency $f_0$ before the frequency adjustment is made. By removing the portions 13*a* and 14*a* of the external ground conducting layers 13 and 14 which correspond to the open circuit ends 15*a*, 16*a* and 17*a* of the respective resonator conducting layers 15, 16 and 17, the center frequency $f_1$ is shifted toward a higher frequency zone so that it becomes identical with the desired response frequency $f_0$ as shown in FIG. 11.

Then, the three-conductor type filter thus adjusted to the desired frequency response is contained in a casing 18 as shown in FIG. 4. The casing 18 may be matal, and has an inner height equal to the height of the filter and a width larger than that of the filter. By selecting the dimension of the casing 18 in this way, the filter device can be constructed without any substantial increasing of the height, and the peripheral portion of the filter can be prevented from bringing into contact with the inner surface of the casing 18. In this case, even if the width of the casing 18 is set larger than that of the filter, the requirement for thinner dimension for electronic circuit elements can be effectively satisfied.

Figure 5:
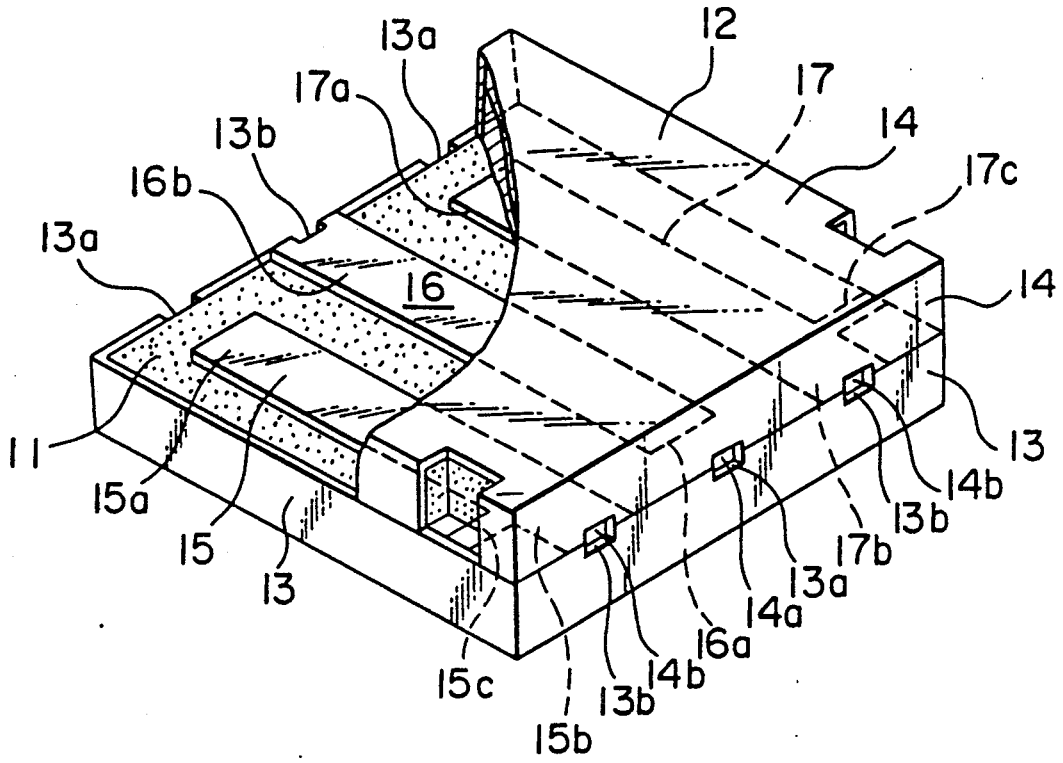
FIG. 5 is a perspective partially cutaway view schematically showing a filter whose frequency response is adjusted in accordance with another embodiment of the present invention.
Figure 6:
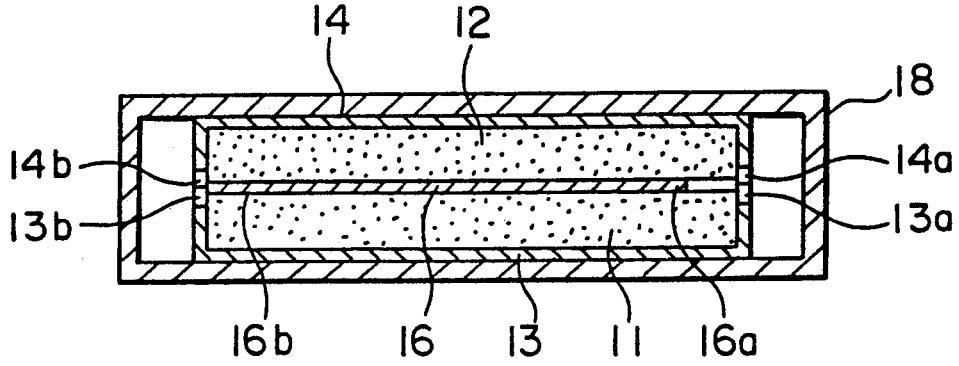
FIG. 6 is a longitudinal section showing the filter device of FIG. 5 contained in a casing.

FIGS. 5 and 6 illustrate another embodiment of the present invention in which an additional adjusting means is provided for shifting the center frequency of the filter toward a lower frequency zone.

Figure 10:
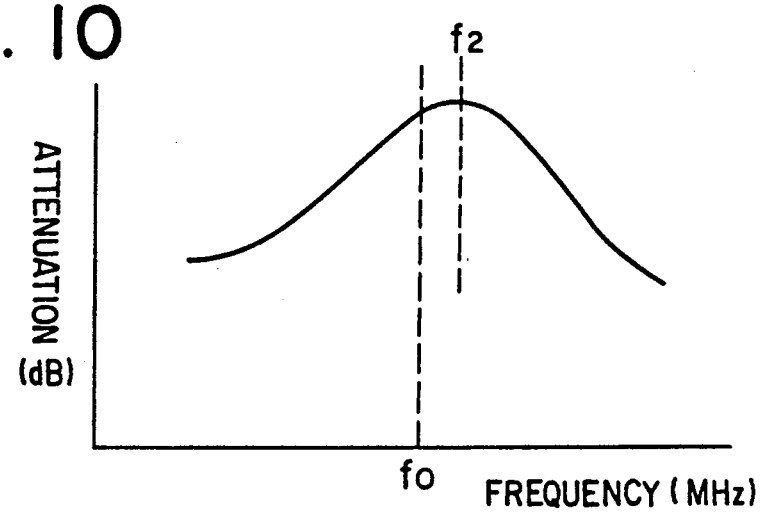

As shown in FIG. 10, there may occur that the center frequency $f_2$ of the filter is shifted over the desired center frequency $f_0$ by the provision of the removed portions 13*a* and 14*a* on the external ground conducting layers 13 and 14 provided on the peripheral surface of the respective substrates 11 and 12 in accordance with the first embodiment. In order to compensate this overshoot, in this embodiment the external ground conducting layers 13 ans 14 provided on the peripheral surfaces of the substrates 11 and 12 are partially removed at portions 13*b* and 14*b* contacted with the short circuit ends 15*b*, 16*b* and 17*b* of the resonator conducting layers 15, 16 and 17. This removing operation may also be performed by means of a cutting tool, laser beam machining, sand blasting or the like as in the case of forming the removed portions 13*a* and 14*a*. Therefore, the capacitance between each removed portion and the associated resonator conducting layer is reduced, so that the center frequency $f_2$ is shifted toward a lower frequency zone so that it becomes identical with the desired response frequency $f_0$ as shown in FIG. 11.

With the illustrated embodiments shown in FIGS. 3 to 6, the upper dielectric substrate 12 may also be provided with a transmission line pattern of resonator conducting layers on the lower surface, which is disposed to have a reflected image relation with respect to the stripline pattern of the resonator conducting layers 15, 16 and 17 on the lower dielectric substrate 11. When being assembled the stripline pattern on the lower dielectric substrate 11 comes into face-to-face contact with the transmission line pattern on the upper dielectric substrate 12 without there being any gaps between the lower dielectric substrate 11 and the upper dielectric substrate 12.

Further, the stripline pattern of the resonator conducting layers 15, 16 and 17 may be formed as a comb type in which the open circuit ends and the short circuit ends thereof are disposed at the same sides, respectively.

Figure 7:
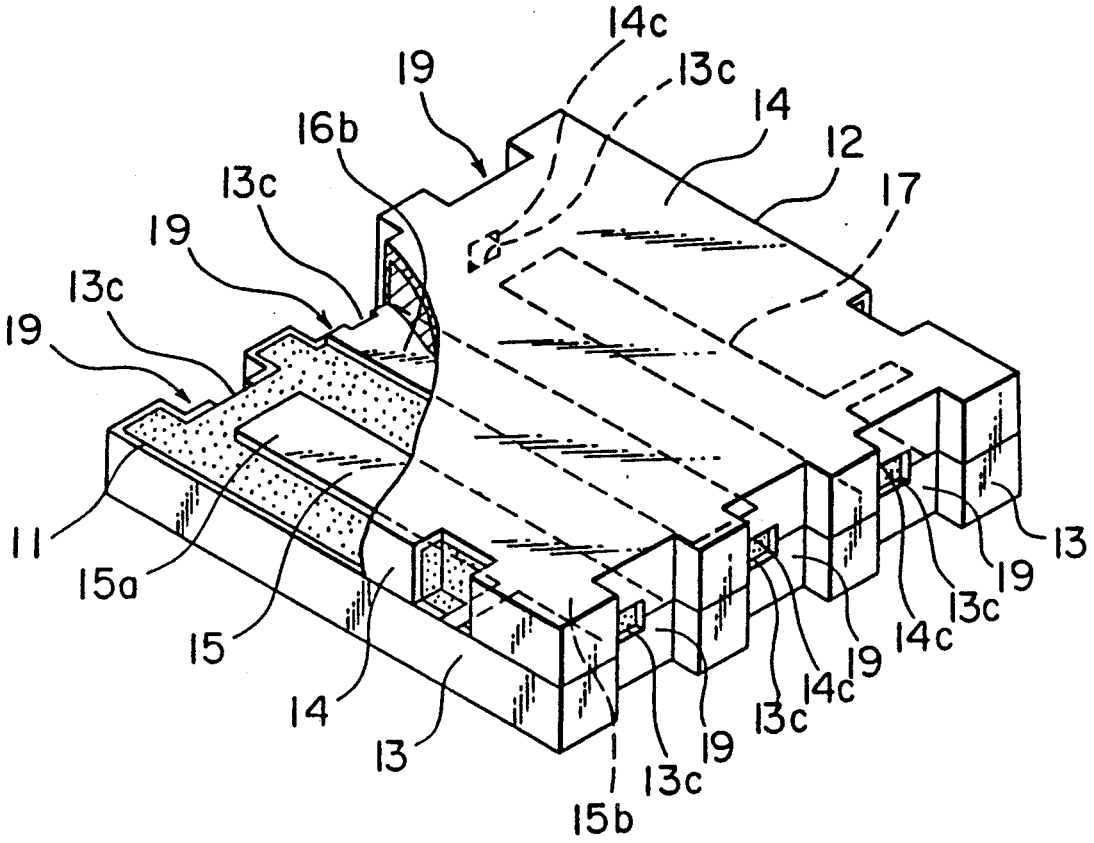
FIG. 7 is a perspective partially cutaway view schematically showing a filter whose frequency response is adjusted in accordance with a further embodiment of the present invention.
Figure 8:
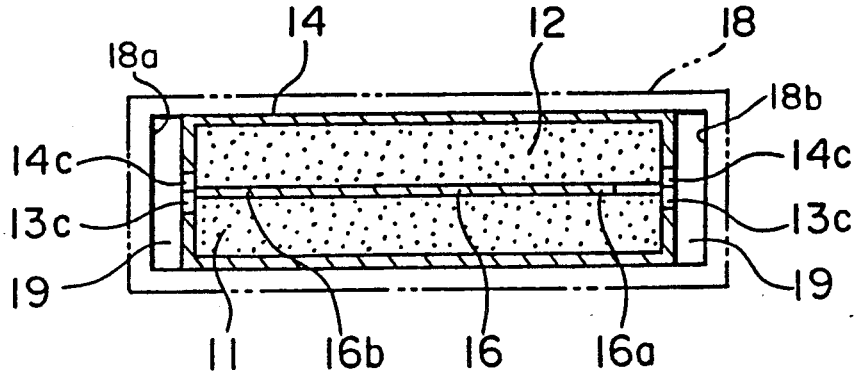
FIG. 8 is a longitudinal section showing the filter device of FIG. 7 contained in a casing.

FIGS. 7 and 8 shows a further embodiment in which rectangular recesses 19 are provided on the portions of the dielectric substrates 11 and 12 which are opposite to the open circuit ends 15*a*, 16*a* and 17*a* and the short circuit ends 15*b*, 16*b* and 17*b* of the resonator conducting layers 15, 16 and 17. In this embodiment the adjustment of the frequency response can be performed by partially removing the portions of the ground conductor layers 13 and 14 provided on these recesses 19 as designated by 13*c* and 14*c*. When the filter is inserted into the casing 18 the removed portions 13*c* and 14*c* can be spaced from the inner end surfaces 18*a* and 18*b* of the casing 18, and thus the portions of the dielectric substrates 11 and 12 exposed through the removed portions 13*c* and 14*c* can be prevented from bring into contact with the associated inner end surface of the casing 18. Therefore, the capacitance between the ground conductor layer and the associated resonator conducting layer is not changed when the filter is inserted into the casing 18, and consequently, the frequency response of the filter can be stably maintained at the desired level without necessity of any readjustment.

With this embodiment, alternatively, each of the inner end walls 18*a* and 18*b* of the casing 18 is outwards protruded at regions faced to the portions to be removed for the frequency adjustment so as to form inner recesses, thereby preventing the portions of the dielectric substrates 11 and 12 exposed through removed portions from bring into contact with the associated inner end surface of the casing 18.

As described above, according to the present invention the frequency adjusting of the filter is performed by partially removing the ground conducting layer provided on the peripheral portion of each dielectric substrate at regions corresponding to the open circuit ends, or to the open circuit ends and the short circuit ends of the resonator conducting layers. Therefore, since the outer conductor of the filter is not removed at regions which are to be abutted on the inner surface of a casing as in the case of the conventional filter device, the present invention has an advantage that there is no variation or deviation in the set frequency characteristic of the filter when the filter device is completed by inserting the filter into the casing. Further, the present invention has also an advantage that a frequency adjustment can be correctly made without increasing the thickness or height of the casing.

It is to be understood that the present invention is not limited to the particular embodiments described and that numerous modifications and alterations may be made by those skilled in the art without departing from the spirit and scope of the invention.

What is claimed is:

1. A method of adjusting a frequency response of a filter device of a three-conductor structure type comprising a pair of dielectric substrates each having a peripheral and outer surfaces provided with an external ground conducting layer, and a plurality of stripline resonator conducting layers sandwiched between said dielectric substrates, each resonator conducting layer having a short circuit end connected to the ground conducting layer on one lateral surface of said each substrate and an open circuit end spaced from the ground conducting layer on the opposite lateral surface of said each substrate, wherein said method comprises the step of partially removing said external ground conducting layer on the peripheral surface of said each substrate at a portion which corresponds to the open circuit end of said each resonator conducting layer to tune filter device to a desired frequency response.

2. A method as claimed in claim 1, wherein said removing step is performed by using a cutting tool, a laser beam machining, or sand blasting.

3. A method of adjusting the frequency response of a filter device of a three-conductor structure comprising a pair of dielectric substrates each having a peripheral and outer surfaces provided with an external ground conducting layer, and a plurality of stripline resonator conducting layers sandwiched between said dielectric substrates, each resonator conducting layer having a short circuit end connected to said ground conducting layer on one lateral surface of said each substrate and an open circuit end spaced from said ground conducting layer on the opposite lateral surface of said each substrate, said method comprising a first step of partially removing said external ground conducting layer on the peripheral surface of said each substrate at a portion which corresponds to the open circuit end of said each resonator conducting layer so as to provide tuning of the filter device to a desired frequency response, and a further step of partially removing said external ground conducting layer on the peripheral surface of said each substrate at a portion which corresponds to the short circuit end of said each resonator conducting layer so as to compensate for any overshoot of the tuning provided by said first step.

4. A method as claimed in claim 3, wherein said each removing step is performed by using a cutting tool, laser beam machining, or sand blasting.

5. A method of adjusting a frequency response of a filter device of a three-conductor structure comprising a pair of dielectric substrates each having a peripheral surface provided with a pluraeity of recesses and an outer surface, an external ground conducting layer provided on the peripheral and outer surfaces of said each dielectric substrate, and a plurality of stripline resonator conducting layers sandwiched between said dielectric substrates, each resonator conducting layer having a short circuit end connected to the ground conducting layer on one lateral surface of said each substrate and an open circuit end spaced from the ground conducting layer on the opposite lateral surface of said each substrate, wherein said method comprises the step of partially removing said external ground conducting layer on the peripheral surface of each said substrate defining the recesses at a portion which corresponds to the open circuit end of said each resonator conducting layer so as to increase the response frequency of the filter device to a desired level.

6. A method as claimed in claim 5, wherein said each removing step is performed by using a cutting tool, laser beam machining, or sand blasting.

7. A filter device of a three-conductor structure type comprising a pair of dielectric substrates having a peripheral and outer surfaces; an external ground conducting layer provided on the peripheral and outer surfaces of said each dielectric substrate; a plurality of stripline resonator conducting layers sandwiched between said dielectric substrates, each resonator conducting layer having a short circuit end connected to said ground conducting layer on one lateral surface of said each substrate and an open circuit end spaced from said ground conducting layer on the opposite lateral surface of said each substrate, said external ground conducting layer provided on the peripheral surface of said each dielectric substrate having a portion removed for changing a capacitance between said ground conducting layer and each of said stripline resonator conducting layers sandwiched between said dielectric substrates; and a casing for containing a filter assembly of said dielectric substrates and said resonator conducting layers, said casing having an inner height equal to the thickness of said filter assembly.

* * * * *